United States Patent [19]

Storch et al.

[11] Patent Number: 4,642,624

[45] Date of Patent: Feb. 10, 1987

[54] WIDTH CARD

[75] Inventors: Leonard Storch, New York, N.Y.; Robert Hotto, Pacific Beach, Calif.

[73] Assignee: Leonard Storch Enterprises, Inc., New York, N.Y.

[21] Appl. No.: 569,784

[22] Filed: Jan. 10, 1984

[51] Int. Cl.[4] ..... B41B 17/04; G09G 1/16

[52] U.S. Cl. ..... 340/735; 178/30; 354/13; 340/731

[58] Field of Search ..... 340/735, 720, 731, 748; 364/523; 354/12, 13, 6; 178/15, 30

[56] References Cited

U.S. PATENT DOCUMENTS

| | | | |
|---|---|---|---|
| Re. 28,785 | 0/1976 | Hanson et al. | 354/292 |
| 2,924,157 | 0/1960 | Friedman | 95/4.5 |
| 3,546,681 | 12/1970 | Korn et al. | 340/735 |
| 3,712,443 | 0/1973 | Matthews | 197/84 A |
| 3,911,420 | 10/1975 | Lanpson | 340/735 |
| 3,930,251 | 12/1975 | Salara et al. | 364/523 |
| 4,121,228 | 10/1978 | Cowe et al. | 340/735 |

*Primary Examiner*—Gerald L. Brigance

[57] ABSTRACT

A width card associated with a film strip both of which are adapted to be used in a phototypesetting machine, the film strip containing a plurality of fonts, each of which contains a plurality of characters. The width card includes a memory for storing a plurality of sets of character width information for each of the fonts contained on the associated film strip, means for selecting one of the sets of character width information for all of the fonts contained on the associated film strip and means for permitting the phototypesetting machine to obtain from the memory the width information for a character in a particular font by accessing the selected set of character width information for the particular font. In response to access of the memory by the phototypesetting machine, a visual indication of the particular font accessed and the set of character width information selected is provided.

8 Claims, 1 Drawing Figure

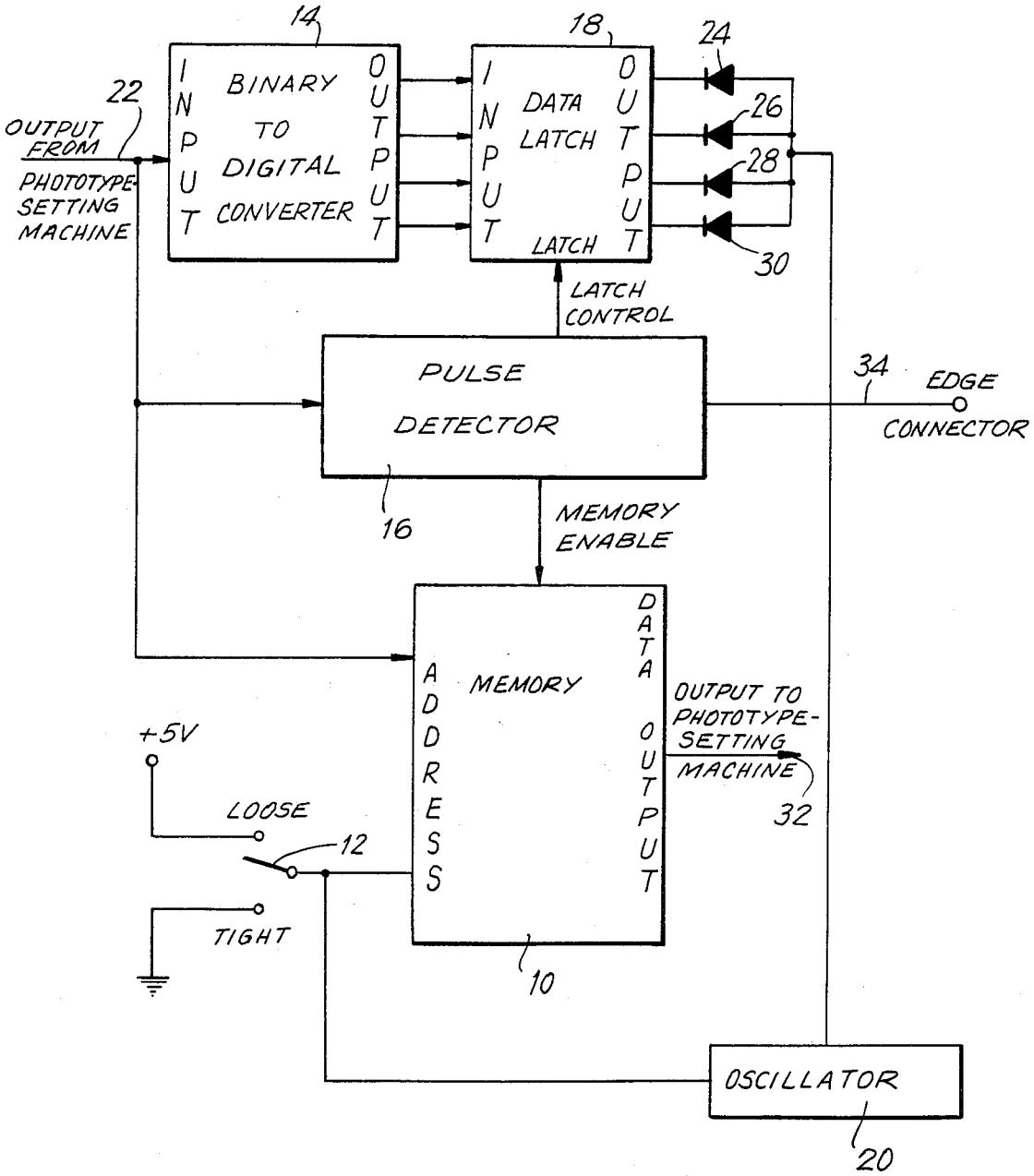
14
18
24
22
OUTPUT FROM PHOTOTYPE-SETTING MACHINE
INPUT
BINARY TO DIGITAL CONVERTER
OUTPUT
INPUT
DATA LATCH
OUTPUT
LATCH
26
28
30
LATCH CONTROL
PULSE DETECTOR
34
EDGE CONNECTOR
16
MEMORY ENABLE
ADDRESS
MEMORY
DATA OUTPUT
OUTPUT TO PHOTOTYPE-SETTING MACHINE
32
+5V
LOOSE
12
TIGHT
10
OSCILLATOR
20

WIDTH CARD

The invention relates to phototypesetting machines and more particularly to an improved width card for use with a film strip in phototypesetting machines.

Phototypesetting machines enable the preparation of manuscript for printing by projecting images of type characters onto photographic film which is then used to make printing plates. These phototypesetting machines are widely used and have largely replaced the antiquated linotype machines which set a line of type on a single metal slug.

Typical phototypesetting machines, such as those sold under the designation "Compugraphic", include a keyboard, a display and a drum which receives a pair of film strips. Each film strip contains four fonts, each font being a complete set of type (letters, mathematical symbols, accents, stars, boxes, rules, leaders, trademark and copyright symbols, etc., which are hereinafter collectively referred to as characters) having a specific type size and type face. Most phototypesetting machines can accommodate two film strips and their associated width cards, permitting use of eight different fonts at any one time.

Associated with each film strip is a width card which contains the specific character width information for each of the fonts on the film strip. Each character in each font has a different width from other characters in the same font and from the same character in a different font. The width card associated with each film strip includes four sets of character width information, one set for each of the fonts on the film strip.

The width cards for each of the film strips are received in sockets on the phototypesetting machine corresponding to the particular drum on which the associated film strips are secured. The width information for each character of each font is then obtained from the width cards by the phototypesetting machine to accurately space and position the characters.

During use, the phototypesetter selects the desired font and begins typing the manuscript which then appears on the display. The phototypesetter will normally change fonts during any one job, i.e. to use italic type. With each change of font, the phototypesetting machine will access, from the width card, the particular width information of that font for the characters chosen, and space the characters accordingly.

Width cards currently used in phototypesetting machines have several disadvantages. For example, the width cards contain only one set of width information for each font thereby restricting the spacing of the letters selected from that font to one specific spacing. While phototypesetting machines do allow a tightening (less space between letters) of that specific spacing, a looser spacing (more space between letters) is not possible. This lack of versatility is a distinct drawback in many applications. In addition, width cards provide no indication of the particular font selected. The characters appearing on the screen will look the same no matter which font is chosen and therefore they do not indicate the particular typeface selected. While the display screen may indicate a number (from one to eight) indicating the font number, the name of the font is not indicated.

Accordingly, it is an object of the present invention to provide an improved width card which permits selection of at least a first or a second spacing of the characters of any one font.

Another object of the present invention is to provide an improved width card for use in phototypesetting machines which indicates the name of the particular font selected.

Still another object of the present invention is to provide a width card for use in phototypesetting machines which provides a visual indication of which spacing information has been selected.

In accordance with the present invention there is provided an improved width card associated with a film strip, both of which are adapted for use in a phototypesetting machine, the film strip containing a plurality of fonts each of which contains a plurality of characters. The width card includes a memory for storing a plurality of sets of character width information for each of the fonts contained on the associated film strip, means for selecting one of the sets of character width information for all of the fonts contained on the associated film strip and means for permitting the phototypesetting machine to obtain from the memory the width information for a character in a particular font by accessing the selected set of character width information for the particular font. In response to access of the memory by the phototypesetting machine, a visual indication of the particular font accessed and the set of character width information selected is provided.

The accompanying drawing, to which reference is made in the instant specification and in which like reference characters are used to indicate like parts in the various views, is a schemetic diagram of that improved width card of the present invention and is identified as FIG. 1.

By way of background, phototypesetting machines conventionally include a keyboard, a display and a film strip receiving drum. Before use of the phototypesetting machine, one or two film strips are secured to the drum and a pair of width cards, each associated with one of the film strips, are plugged into conformingly shaped sockets (located on the phototypesetting machine) corresponding to the location on the drum on which the associated film strip is secured. Each of the two film strips contain four different fonts, as such, the phototypesetter may select from eight different fonts at any one time.

The invention is directed to an improved width card for use with a conventional film strip in an otherwise conventional phototypesetting machine. Referring now to FIG. 1, the improved width card, associated with a film strip which is not shown, includes a memory 10, such as an erasable programmable read only memory, a switch 12, a binary to digital converter 14, a pulse detector 16, a latch 18 and an oscillator 20.

Stored within the memory 10 is the width information for each of the characters in each of the fonts contained on the associated film strip. The associated film strip contains four fonts or four complete sets of characters, each set having a distinct type size and type style. Memory 10 contains at least two complete sets of character width information for each font, therefore having a total of eight sets of character width information.

Preferably, the two sets of character width information for each particular font are a first set which spaces the characters to give the appearance that is generally accepted by phototypesetting machine users as the normal or preferred fit ("tight") and a second set of character width information which spaces the characters to give the appearance of a high quality "metal" composition ("loose"). The "loose" set of character width information is preferred to set type for television and other types of work. The selection of the particular set of character width information is usually done at the beginning of a particular job and typically remains the same throughout that job. The selection of the "loose" or "tight" set of character width information for all of the fonts is made by setting switch 12 to either the "loose" or "tight" position. Switch 12 is connected to one of the address pins of the memory 10 such that if the switch is set in the "loose" position the memory will permit access of only the "loose" set of character width information for all of the fonts, and if the switch is set in the "tight" position the memory will permit access of only the "tight" set of character width information for all of the fonts. For example, once the phototypesetter has selected the tight spacing for all of the fonts, upon the selection of any particular font, the width card will provide only the tight set of character width information corresponding to the particular font selected. The manner of programming memory 10 is well understood by those skilled in the art and need not be discussed in any detail herein.

Switch 12 is located along the exterior portion of the width card and is adapted for manual operation by the phototypesetter. It is preferred that the switch 12 be located on a portion of the width card which is not readily accessible once the width card is inserted into the phototypesetting machine. This will serve to prevent inadvertant changes in the selection of the set of character information.

During use of the phototypesetting machine, the phototypesetter will select the desired font by pressing a key on the keyboard. The keyboard is then used to key the material, typically manuscript, which appears on the display screen. Each time the phototypesetter depresses character key on the keyboard, the phototypesetting machine requests the character width information for that character in the particular font selected. The phototypesetting machine will also request character width information during the printing out of a job.

The output from the phototypesetting machine requesting the character width information is directed along lines 22 to the binary to digital converter 14, pulse detector 16 and memory 10. The binary to digital converter 14 provides input to latch 18 as to which of the four fonts on the film strip has been selected. The output of latch 18 is connected to four light emitting diodes 24, 26, 28 and 30 each of which is associated with a particular font.

The output from the phototypesetting machine requesting access of the memory is tyically a distinct signal such as a long pulse (greater than one microsecond). In order to differentiate the distinct access request from other signals, machine functions and noise, pulse detector 16 is adapted to sense pulses longer than, for example, three microseconds. Upon the detection of a long pulse (indicating a true access request) pulse detector 16 will enable memory 10 to supply to the phototypesetting machine, along lines 32, the character width information for the selected font. As described previously, the data selected will either be the "loose" character width information or the "tight" character width information depending on the setting of the switch 12.

In addition, upon the detection of an access request, pulse detector 16 will enable data latch 18 which will then transfer the information on its input lines to its output lines thereby illuminating the light-emitting diode 24, 26, 28 or 30 corresponding to the selected font. The light-emitting diodes are contained adjacent to the exterior of the width plug such that they may be seen by the phototypesetter when illuminated, and so that they indicate the name of their associated font. To this end, the names of each of the fonts contained on the associated film strip are printed on the exterior portion of the width card adjacent to their associated light-emitting diodes to permit viewing by the phototypesetter. In the alternative, the names of the different fonts may be printed on transparent material and the light-emitting diodes may be used to illuminate the name of the particular font selected.

An oscillator 20 receives input from switch 12 and controls the output of the light-emitting diodes 24, 26, 28 and 30 accordingly. For example, if the switch is set in the "tight" position the light-emitting diode for the particular font selected will be illuminated and remain illuminated steadily. If the "loose" position is selected the oscillator 20 will be enabled to cause the illuminated light-emitting diode to blink, thereby indicating the selection of the "loose" character width information. If memory 10 contains more than two sets of character width information for each of the fonts, a different rate of blinking can be used to indicate each set.

When two film strips are used in one phototypesetting machine at one time, thereby providing eight fonts for the phototypesetter to choose from, the width cards are plugged into the phototypesetting machine, each corresponding to one of the film strips. The two width cards communicate with each other through an edge connector 34 which is coupled to the pulse detector 16. This requires coupling of the two connectors 34 by an external connector. This communication between the two width cards permits the width card containing the character width information for the selected font to communicate with the other width card to prevent the inadvertant illumination of any of the light-emitting diodes on the unselected width card. Specifically, the pulse detector 16 which senses the access request and enables latch 18 and memory 10, also disables the pulse detector on the unselected width card.

As will be readily apparent to those skilled in the art, the invention may be used in other specific forms or for other purposes without departing from its spirit or central characteristics. The present embodiments are therefore to be considered as illustrative and not restrictive, the scope of the invention being indicated by the claims rather than by the foregoing description, and all embodiments which come within the range of equivalence of the claims are intended to be embraced.

We claim:

1. A width card associated with a film strip containing a pluralilty of fonts each of said fonts containing a plurality of characters, said width card and said film strip adapted to be used with a phototypesetting machine, comprising a memory for storing a first set and a second set of character width information for each of said fonts contained on said associated film strip, means for permitting the selection of either said first set or said second set of character width information for all of said fonts contained on said associated film strip, means for permitting said phototypesetting machine to obtain from said memory the width information for a character in a particular font by accessing the selected set of character width information for the particular font from said memory, and means responsive to access of said memory by said phototypesetting machine for providing a visual indication of the particular font accessed and the set of character width information selected.

2. Apparatus as in claim 1 in which said first set of character width information for each of said fonts spaces said characters in each of said fonts with a first spacing and said second set of character width information for each of said fonts spaces said characters in each of said fonts with a second spacing, said second spacing being greater than said first spacing.

3. Apparatus as in claim 2 in which said means responsive to access of said memory by said phototypesetting machine for providing a visual indication of the particular font accessed and the set of width information selected, comprises a plurality of light emitting diodes each corresponding to a particular font, means for detecting the particular font accessed to select the corresponding light emitting diode, means for producing a signal upon the access of said memory by said phototypesetting machine, means responsive to said signal for illuminating said selected light emitting diode, and means responsive to the set of width information selected for causing said illuminated diode to blink if said second set of width information is selected.

4. Apparatus as in claim 1 in which said width card and said film strip adapted to be used with said phototypesetting machine are also adapted to be used with a second width card and a second film strip and said phototypesetting machine.

5. A width card associated with a film strip containing a plurality of fonts, each of said fonts containing a plurality of characters, said width card and said film strip adapted to be used with a phototypesetting machine, comprising a memory for storing a plurality of sets of character width information for each of said fonts contained on said associated film strip, means for permitting the selection of one of said sets of character width information for all of said fonts contained on said associated film strip, means for permitting said phototypesetting machine to obtain from said memory the width information for a character in a particular font by accessing the selected set of character width information for the particular font, and means responsive to access of said memory by said phototypesetting machine for providing a visual indication of the particular font accessed and the set of character width information selected.

6. A width card associated with a film strip containing a plurality of fonts each of said fonts containing a plurality of characters, said width card and said film strip adapted to be used with a phototypesetting machine, comprising a memory for storing a set of character width information for each of said fonts contained on said associated film strip, means for permitting said phototypesetting machine to obtain from said memory the width information for a character in a particular font by accessing the set of character width information for the particular font, and means responsive to access of said memory by said phototypesetting machine for providing a visual indication of the particular font accessed.

7. A width card associated with a film strip containing a plurality of fonts each of said fonts containing a plurality of characters, said width card and said film strip adapted to be used with a phototypesetting machine, comprising a memory for storing a first set and a second set of character width information for each of said fonts contained on said associated film strip, means for permitting the selection of either said first set or second set of character width information for all of said fonts contained on said associated film strip, means for permitting said phototypesetting machine to obtain from said memory the width information for a character in a particular font by accessing the selected set of character width information for the particular font.

8. Apparatus as in claim 7 in which said first set of character width information for each of said fonts spaces said characters in each of said fonts with a first spacing and said second set of character width information for each of said fonts spaces said characters in each of said fonts with a second spacing, said second spacing being greater than said first spacing.

* * * * *